US006825237B2

(12) United States Patent
Schweitzer et al.

(10) Patent No.: US 6,825,237 B2
(45) Date of Patent: Nov. 30, 2004

(54) METHOD FOR PRODUCING HYDROCARBONS FROM SYNGAS IN THREE-PHASE REACTOR

(75) Inventors: Jean-Marc Schweitzer, Serpaire (FR); Pierre Galtier, Vienne (FR); Francois Hugues, Charly (FR); Cristina Maretto, Padua (IT)

(73) Assignees: Institut Francais DuPetrole, Rueil-Malmaison Cedex (FR); AGIP Petroli S.p.A., Rome (IT); ENI S.p.A., Rome (IT)

( * ) Notice: Subject to any disclaimer, the term of this patent is extended or adjusted under 35 U.S.C. 154(b) by 0 days.

(21) Appl. No.: 10/239,395

(22) PCT Filed: Feb. 28, 2001

(86) PCT No.: PCT/FR01/00595

§ 371 (c)(1),
(2), (4) Date: Sep. 26, 2002

(87) PCT Pub. No.: WO01/72928

PCT Pub. Date: Oct. 4, 2001

(65) Prior Publication Data

US 2003/0109590 A1 Jun. 12, 2003

(30) Foreign Application Priority Data

Mar. 27, 2000 (FR) ..... 00 03925

(51) Int. Cl.[7] ..... C07C 27/00

(52) U.S. Cl. ..... 518/715; 518/700

(58) Field of Search ..... 518/700, 715

(56) References Cited

U.S. PATENT DOCUMENTS 5,348,982 A 9/1994 Herbolzheimer et al.

FOREIGN PATENT DOCUMENTS

EP 0450861 B 10/1991
WO WO 9903574 A 1/1999

*Primary Examiner*—J. Parsa
(74) *Attorney, Agent, or Firm*—Miller, White, Zelano, Branigan, P.C.

(57) ABSTRACT

A process for synthesising hydrocarbons by reacting a mixture comprising at least carbon monoxide and hydrogen in the presence of a catalyst is carried out in a three-phase reactor in which the liquid Peclet number is in the range 0 (excluded) to about 10, with a superficial gas velocity $U_g$ that is preferably less than 35 $cm.s^{-1}$, to encourage gas transfer into the liquid phase and avoid too much attrition of the catalyst grains.

20 Claims, 2 Drawing Sheets

METHOD FOR PRODUCING HYDROCARBONS FROM SYNGAS IN THREE-PHASE REACTOR

The present invention relates to synthesising heavy hydrocarbons using the Fischer-Tropsch reaction, i.e., the production of hydrocarbons by reacting a mixture essentially containing carbon monoxide and hydrogen and possibly carbon dioxide. That mixture is also known as synthesis gas.

More particularly, the present invention relates to a process for synthesising hydrocarbons by reacting a mixture comprising at least carbon monoxide and hydrogen in the presence of a catalyst carried out in a three-phase reactor and in which the liquid Peclet number ($Pe_l$) is in the range 0 (excluded) to about 10.

PRIOR ART

Synthesising hydrocarbons by the reaction known as the Fischer-Tropsch reaction is an industrial process that is well known for the production of hydrocarbons that are essentially paraffinic, such as naphtha or gas oil fractions or heavier fractions such as waxes (long chain paraffins). Such hydrocarbons can be converted into fuels (gas oil, kerosene) and/or into lubricants in a consecutive step such as isomerising hydrocracking.

The hydrocarbons can be produced catalytically by chemical conversion of synthesis gas that is rich in hydrogen and carbon monoxide, generally obtained from natural gas or coal. Synthesis gas can also contain carbon dioxide. The pressures used are generally about 5 to about 200 bars absolute, normally about 5 to about 80 bars absolute and usually about 10 to about 60 bars absolute (10 bars=1 MPa), and the reaction temperatures are normally about 130° C. to about 400° C., normally about 150° C. to about 350° C. and usually about 200° C. to about 300° C.

The catalysts used in the process, and the methods for producing these catalysts are well known to the skilled person. Such catalysts can be of a variety of natures, and usually contain at least one metal from group VIII of the periodic table (groups 8, 9 and 10 of the new periodic table), preferably dispersed on a support that is usually mineral. Frequently, the catalyst contains at least one metal selected in the group consisting of iron, cobalt and ruthenium and usually selected in the group consisting of iron and cobalt.

The support is generally a porous material and usually a porous inorganic refractory oxide. By way of example, the support can be selected in the group consisting of alumina, silica, titanium oxide, zirconia, rare earths or mixtures of at least two of these porous minerals. Typically, the quantity of metal present in the catalyst is about 1 to about 100 parts by weight per 100 parts by weight of support and usually about 5 to about 50 parts by weight per 100 parts by weight of support.

The catalyst can also contain promoters such as those cited in the following patents: British patent GB-A-2 291 819, European patents EP-A-0 581 619, EP-B-0 764 465, U.S. Pat. No. 5,783,607, French patent FR-A-2 782 319, cited by way of reference, the description of which should be considered to be included in the present description by dint of this citation.

Several types of reactor can be used for the Fischer-Tropsch reaction, the catalyst being used either in an entrained bed, or in a reactor of the slurry bubble column or bubble column reactor type in which a gas is brought into contact with a liquid/very finely divided solid mixture, or slurry. The term "slurry" will be used in the remainder of the description to designate a suspension of solid particles in a liquid. The very high heat of reaction is normally eliminated using a cooling exchanger that is generally inside the reactor.

Fischer-Tropsch synthesis facilities also comprise separation means to separate firstly liquid hydrocarbons and secondly gaseous products that are residual or formed as secondary products during the synthesis, mainly comprising inert compounds, light gaseous hydrocarbons and the unreacted fraction of the synthesis gas.

The desired products are generally separated substantially completely from the catalyst (for example until the amount of residual catalyst is of the order of 1 to a few parts per million (ppm)), to enable its use or treatment in subsequent steps.

Typically, the quantity of solid particles of catalyst in the slurry represents 10% to 65% by weight of the slurry. These particles usually have a mean diameter in the range about 10 to about 800 microns. Finer particles may be produced by attrition, i.e., fragmentation of the initial catalyst particles.

The Fischer-Tropsch synthesis is a synthesis reaction that aims to produce essentially paraffinic hydrocarbons essentially containing more than 5 carbon atoms per molecule ($C_5^+$ hydrocarbons). This reaction is exothermic. Further, the catalyst and operating conditions are usually selected so as to minimise the formation of methane, which is not a desired product. That reaction is particularly exothermic and has a higher activation energy than the principal $C_5^+$ paraffin formation reaction.

European patent application EP-A-0 450 861 describes the use of a Fischer-Tropsch catalyst based on cobalt dispersed on titanium oxide in a slurry bubble column type reactor. Further, EP-B-0 450 860 describes a method for operating that type of reactor in an optimal manner.

Those two documents indicate that the performance of the catalysts essentially depends on the concentration of gaseous reactant (synthesis gas) in the reactor, i.e., on the partial pressure of carbon monoxide and hydrogen in the reaction zone.

In hydrodynamics terms, those documents then indicate that in a perfectly mixed reactor, such as a fully back-mixed reactor or CSTR, the composition of gaseous reactants and liquid and gaseous products and the concentration of catalyst are the same at any point in the reactor. Thus, those perfectly mixed reactors lead to the highest selectivity for $C_5^+$ hydrocarbons, but to the detriment of productivity.

In contrast, in a plug flow reactor, the partial concentration of reactant decreases along the entire length of the reaction zone, and that type of reactor results in the highest productivities to the detriment of selectivity.

EP-B-0 450 860 indicates that Peclet numbers for the gas phase of more than 10, also known as "gas Peclet numbers or $Pe_g$", lead to a plug flow type operation regarding the gas phase, while gas Peclet numbers ($Pe_g$) of less than 1 correspond to systems in which the gas phase is perfectly mixed or stirred. Ideal perfectly stirred systems correspond to Peclet numbers tending towards zero. This Peclet number is equal to $Pe_g = H\, u_g/D_{ax}$, where H is the expansion height of the catalytic bed, $u_g$ is the space velocity of the gas and $D_{ax}$ is the axial dispersion coefficient of the gas phase.

The method that can produce an optimal slurry bubble column that is described in EP-B-0 450 860 comprises injecting gas at a mean superficial velocity such that the formation of slug flow is avoided, the gas superficial velocity being 0.2 ($H/D_{ax}$) or more. A further condition applies to the superficial velocity of the liquid and the sedimentation rate of the solid (generally the catalyst) so that the solid is suitably fluidised in the liquid phase.

Those documents do not take thermal effects into account, nor the presence of an undesirable methanation reaction that has a large negative influence on the exothermicity and selectivity of the reaction. Too much exothermicity in the catalyst generally leads to an increase in the formation of methane, a product that is favoured by high temperatures, and a drop in activity, for example by sintering of the active phase (M. E. DRY, "Catalysis Science and Technology", Volume 1, Anderson and Boudart, pages 175 and 198).

Thus, those phenomena result in a substantial reduction in the production of $C_5^+$ hydrocarbons, usually irreversibly.

SUMMARY OF THE INVENTION

The invention concerns a process for converting hydrocarbons by reacting a mixture comprising at least carbon monoxide and hydrogen in the presence of a catalyst, usually based on a group VIII metal, carried out in a three-phase reactor and in which the liquid Peclet number ($Pe_l$) is in the range 0 (excluded) to about 10, preferably in the range from about 0.005 to about 8, more preferably in the range from about 0.01 to about 5 and highly preferably in the range from about 0.02 to about 3 or in the range from about 0.03 to about 1.

This process can control the reaction on a thermal level and encourage formation of hydrocarbons containing at least 2 carbon atoms per molecule, and can reduce the undesirable formation of methane.

DETAILED DESCRIPTION OF THE INVENTION

The invention concerns a process for synthesising hydrocarbons preferably containing at least 2 carbon atoms in their molecule and more preferably at least 5 carbon atoms in their molecule by bringing a gas essentially containing carbon monoxide and hydrogen into contact in a reaction zone containing a suspension of solid particles in a liquid, which comprises solid particles of a catalyst for the reaction. Said suspension is also termed a slurry. The process of the invention is thus carried out in a three-phase reactor. Preferably, the process of the invention is carried out in a slurry bubble column type three-phase reactor.

The Applicant has discovered that it is important to be able to control the hydrodynamics of the liquid if thermal transfers are to be controlled in the reaction zone, as well as the reaction itself.

In the process of the invention, it is the reactant dissolved in the liquid phase that comes into contact with the catalyst in suspension in said phase and which reacts.

Regarding mass transfer, it is preferable to establish a flow regime in the reactive phase, and thus in the liquid phase which contains dissolved gas, that is as close as possible to plug flow in order to obtain maximum conversion. However, in the case of highly exothermic reactions, plug flow generates a substantial temperature profile that renders thermal control difficult.

The mixture of reactants (hydrogen and carbon monoxide) entering the reactor undergoes the Fischer-Tropsch reaction and this continues as the fluid advances into the column. In this type of reactor function, the concentration and partial pressure of the reactants reduces along the reactor while that of the products (gaseous or liquid) and the water produced by the reaction increases. Plug flow is thus the origin of a concentration gradient associated, in the case of a highly exothermic or highly endothermic reaction, with a substantial temperature gradient along the reactor.

Consider the following reaction scheme, which is well known to the skilled person, for an exothermic reaction of the Fischer-Tropsch type:

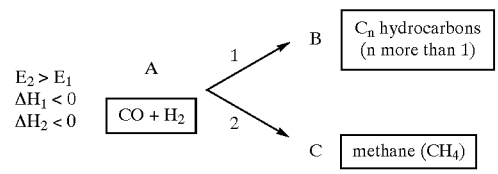

The undesirable parallel reaction, methane formation (reaction 2), has an activation energy (E2) that is higher than that (E1) of the principal hydrocarbon formation reaction. The rate of methane formation thus increases faster with temperature than that of the other hydrocarbons. Further, since the two reactions are exothermic (enthalpies ΔH1 and ΔH2 for reactions 1 and 2 are negative), progress of the reaction causes an increase in the heat released by the reaction, which increases the temperature and thus methanation.

An increase in the temperature gradient along the reactor thus results in a reduction in the selectivity for desired products.

The present invention describes a process whereby the formation of $C_2^+$ hydrocarbons, preferably $C_5^+$ and preferably mainly paraffins $C_nH_{2n+1}$ by reaction 1 is encouraged by controlling the parameters associated with the reaction.

In the case of the reaction scheme described above (reactions 1 and 2), the unsteady state material balance equations can be written as:

$$\text{Species } A: \frac{1}{Pe_l}\cdot\frac{\partial^2 C_A}{\partial Z^2}-\frac{\partial C_A}{\partial Z}-(r_1(C_A)+r_2(C_A))=\frac{\partial C_A}{\partial t^*}$$

$$\text{Species } B: \frac{1}{Pe_l}\cdot\frac{\partial^2 C_B}{\partial Z^2}-\frac{\partial C_B}{\partial Z}+r_1(C_A)=\frac{\partial C_B}{\partial t^*}$$

$$\text{Species } C: \frac{1}{Pe_l}\cdot\frac{\partial^2 C_C}{\partial Z^2}-\frac{\partial C_C}{\partial Z}+r_2(C_A)=\frac{\partial C_C}{\partial t^*}$$

Similarly, the unsteady state energy balance can be written as:

$$\frac{1}{Pe_T}\cdot\frac{\partial^2 T}{\partial Z^2}-\frac{\partial T}{\partial Z}+(r_1(C_A)\cdot(-\Delta H_1)+r_2(C_A)\cdot(-\Delta H_2))\cdot\frac{\tau}{\rho\cdot C_p}-\frac{U\cdot a\cdot\tau}{\rho\cdot C_p}\cdot(T-T_{cont})=\frac{\partial T}{\partial t^*}$$

where $$Pe_l-\frac{u_l\cdot H}{D_{ax}}\quad Pe_T-\frac{\rho\cdot C_P}{\lambda}\cdot u_l\cdot H\quad Z-\frac{z}{H}\quad \tau=\frac{H}{u_l}\quad t^*=\frac{t}{\tau}\quad r_i(C_A)=k_p\cdot\varepsilon^{\frac{E_1}{R\cdot T}}\cdot C_A^n$$

| | |
|---|---|
| a | heat exchange surface density |
| $C_i$ | concentration of species i |
| $C_p$ | liquid heat-capacity rate |
| $D_{ax}$ | axial dispersion coefficient |
| $E_1$ | activation energy of reaction 1 |
| $E_2$ | activation energy of reaction 2 |
| H | expansion height of catalytic bed |
| $Pe_l$ | liquid Peclet number |
| $Pe_T$ | thermal Peclet number |
| $r_1$ | rate of formation of B |
| $r_2$ | rate of formation of C |
| t | time |
| t* | normalised time |
| $u_l$ | liquid velocity |
| U | heat transfer coefficient |
| z | axial position |
| Z | normalised axial position |
| $\Delta H_1$ | enthalpy of reaction 1 |
| $\Delta H_2$ | enthalpy of reaction 2 |
| $\lambda$ | effective thermal conductivity |
| $\rho$ | density of liquid |
| $\tau$ | liquid passage time |

Given that the thermal dispersion very closely follows the mass dispersion, equality of the thermal Peclet number and the mass Peclet number for the liquid phase $Pe_l$ constitutes a reasonable hypothesis that is accepted by the skilled person (P. L. MILLS et al., "Three-Phase Sparged Reactors" in Topics in Chemical Engineering, volume 8, chapter 5, p. 364, K. D. P. NIGAM and A. SCHUMPE editors, GORDON and BREACH, publishers). The selectivity for product B and the temperature profile along the column can then be determined by solving the above equations. Solution leads to the results shown in FIGS. 1 and 2.

During Fischer-Tropsch synthesis, the selectivity for desirable products B ($C_2^+$ hydrocarbons) reduces when the temperature differential in the reactor increases, and the liquid Peclet number $Pe_l$ appears to be a reaction control parameter.

Further, the liquid phase Peclet number should not be zero in order to distinguish it from a perfectly stirred reactor in which conversion is minimal.

Figure 1:
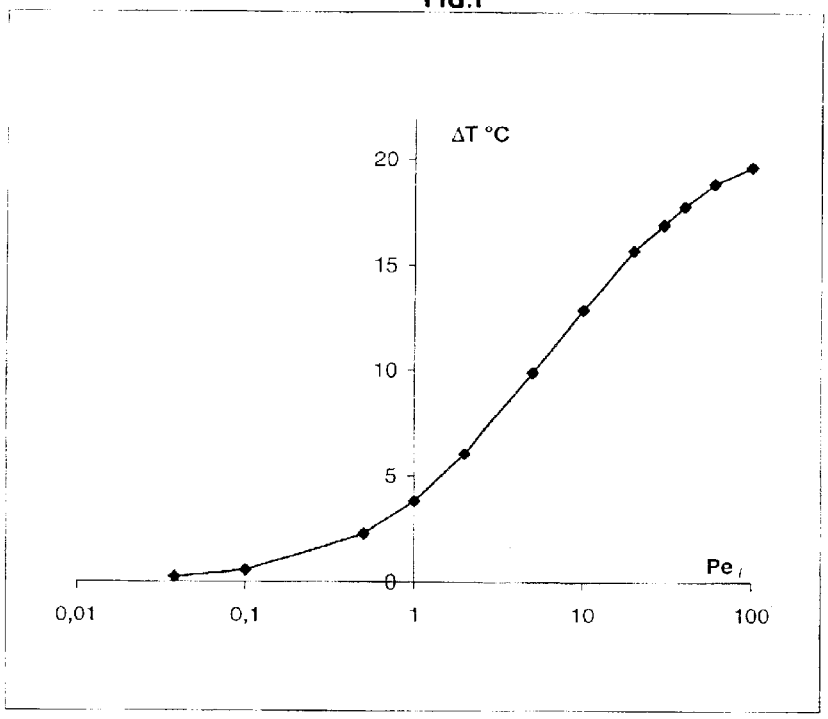
FIG. 1 shows the development of the temperature differential ($\Delta T$), i.e., the increase in temperature due to reactions 1 and 2, as a function of the liquid Peclet number ($Pe_l$). This temperature differential increases substantially for liquid Peclet numbers of more than a few units. For suitable thermal control of the Fischer-Tropsch reaction, the temperature differential is preferably kept to less than 15° C., preferably less than 10° C. It is thus preferable to operate with a liquid Peclet number of less than about 10, preferably about 8. Beyond these values, controlling the exothermicity of the reaction can become difficult or even impossible.
Figure 2:
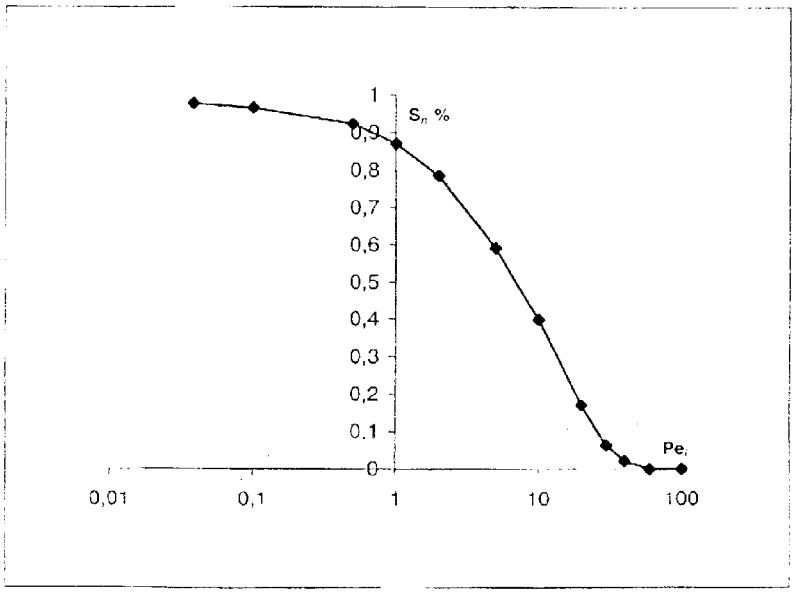
FIG. 2 shows the development of the selectivity (Se) for desired products ($C_n$ hydrocarbons, where n is greater than 1, i.e., $C_2^+$ hydrocarbons) as a function of the liquid Peclet number ($Pe_l$). Thus, it appears from the figure that selectivity decreases more significantly when the liquid Peclet number exceeds a few units.

The lower limit for the Peclet number depends on the activity of the catalyst in a perfectly stirred reactor, thus inter alia on its composition and/or its preparation method. When the Peclet number increases, conversion also increases. However, it is preferable for the Peclet number not to be too high in order to avoid a temperature profile that renders thermal control difficult and leads to too low a selectivity for the desired product, as shown in FIGS. 1 and 2.

As a result, a high selectivity for $C_2^+$ hydrocarbons (i.e., a selectivity of more than 60%, preferably more than 70% by weight, more preferably more than 80% by weight and highly preferably more than 90% by weight) and sufficient conversion (i.e., a carbon monoxide conversion of more than 60%, preferably more than 70%, more preferably more than 80%) corresponds to a high productivity of $C_2^+$ products and will be obtained when the liquid Peclet number $Pe_l$ is non zero and is as high as possible, while remaining below an upper limit beyond which thermal control becomes difficult and/or selectivity for $C_2^+$ hydrocarbons becomes too low.

In the process of the invention, the Peclet number $Pe_l$ is thus in the range 0 (excluded) to about 10, preferably in the range from about 0.005 to about 8, more preferably in the range from about 0.01 to about 5 and still more preferably in the range from about 0.02 to about 3, or even in the range from about 0.03 to about 1.

When the liquid Peclet number is in the range cited above, a Fischer-Tropsch type hydrocarbon synthesis process is obtained with performances that are optimised as regards conversion and selectivity for $C_2^+$ hydrocarbons or even $C_5^+$ hydrocarbons, and better control of the heat released by the reaction, which can also avoid too great a deactivation of the catalyst in the case of exothermic reactions.

It may also be advantageous and preferable to operate with a superficial gas velocity that can avoid the formation of pockets of gas (slugs). However, this phenomenon is really only important when the reactor diameter is small, i.e., the diameter is less than 6 metres (6 m), or even less than 2 metres (2 m).

Further, the process of the invention is preferably carried out with a superficial gas velocity $U_g$ of less than 35 $cm.s^{-1}$, more preferably less than 30 $cm.s^{-1}$, to encourage gas transfer into the liquid phase and thus to encourage the reaction, but also to avoid too much attrition of the catalyst grains.

Figure 3:
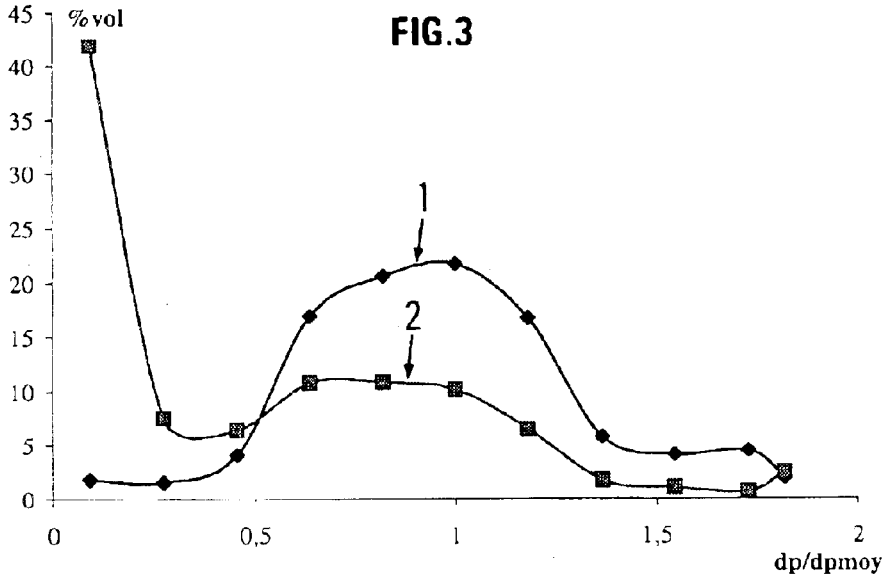
Figure 4:
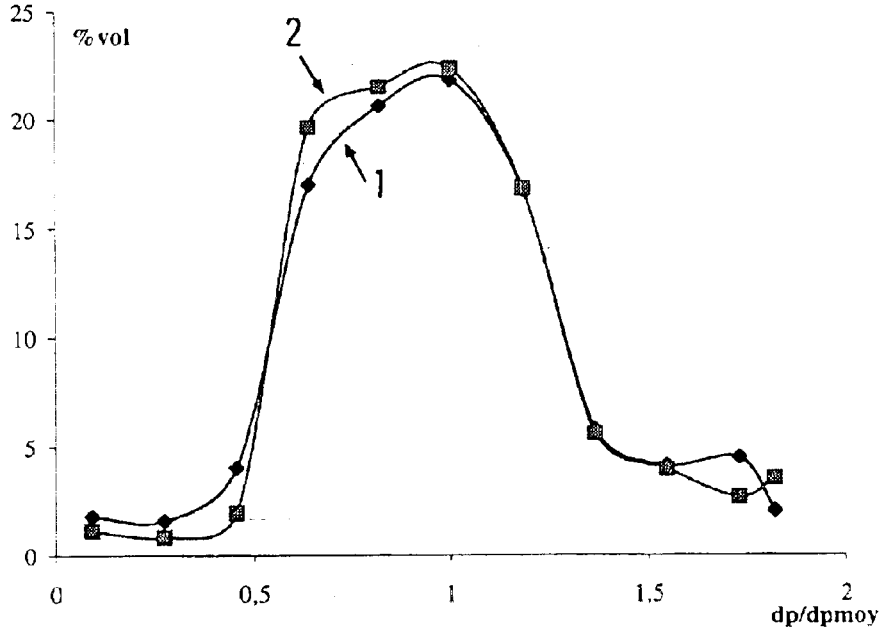

FIGS. 3 and 4 represent the particle size distribution of a Fischer-Tropsch catalyst before the reaction (curves 1) and after 10 days of test in a three-phase reactor (curves 2). This distribution is visualised in terms of the volume % of particles for different values of the ratio $d_p/d_{pmean}$ (the ratio between the catalyst particle diameter and the mean diameter of the ensemble of particles). FIG. 3 was obtained for a superficial gas velocity $U_g$ of 40 cm/s, and FIG. 4 for $U_g$=30 cm/s. Substantial formation of fine particles with a $d_p/d_{pmean}$ of less than 0.5 is obtained when $U_g$ is 40 cm/s (FIG. 3), which is not the case when $U_g$=30 cm/s (FIG. 4).

The process of the invention for producing hydrocarbons using the Fischer-Tropsch synthesis can be carried out in any type of three-phase reactor, preferably in a reactor of the slurry bubble column or bubble column type. It appears to be advantageous to operate in reactors of sufficient size, in particular to obtain sufficiently high hourly production rates (weight of $C_2^+$ hydrocarbons produced per hour). It appears to be preferable to use one or more reactors with a diameter of more than about 2 metres, more preferably more than 6 metres, or even more than 7 metres in the process of the invention.

In order to verify the operating conditions of the process of the invention, in particular the hydrodynamic conditions and the value of the Peclet numbers, it is advantageous to carry out experimental measurements during operation, and also to carry out tests using tracers. Such techniques are known to the skilled person and have been described, for example, in EP-B-0 450 860.

Any type of catalyst that is known to the skilled person can be used in the process of the invention. In general, the catalytic powders used in the process of the invention are based on at least one group VIII metal, i.e., at least one metal selected from groups 8, 9 and 10 of the new periodic table. Preferably, the group VIII metal is iron or cobalt, more preferably cobalt.

The catalyst can contain one or more activation agents (also termed promoters) selected from elements from groups I to VII of the periodic table (groups 1, 2, 3, 4, 5, 6, and 7 of the periodic table). These promoters can be used alone or in combination.

The catalyst can optionally be dispersed on a support, the support then preferably comprising a refractory inorganic oxide selected in the group consisting of aluminas, silica, titanium oxide, zirconia and rare earths.

Preferably, the cobalt-based catalysts described in the following documents are used: GB-A-2 291 819, EP-A-0 581 619, EP-B-0 764 465, U.S. Pat. No. 5,783,607, FR-A-2 782 319.

The operating conditions for the Fischer-Tropsch hydrocarbon synthesis reaction are generally well known. The reactor of the invention generally operates optimally at a temperature in the range 160° C. to 350° C., preferably in the range 200° C. to 300° C., at a pressure in the range 0.1 to 10 MPa, preferably in the range 0.5 to 6 MPa, more preferably in the range 1 to 5 MPa; the $H_2$/CO mole ratio is in the range 0.5 to 3, preferably in the range 1 to 2.5, and more preferably in the range 1.7 to 2.3.

What is claimed is:

1. A process for synthesizing hydrocarbons comprising reacting a mixture comprising at least carbon monoxide and hydrogen in the presence of a catalyst, carried out in a three-phase reactor and in which the liquid Peclet number ($Pe_l$) is in the range of more than 0 to about 10.

2. A process according to claim 1, in which the superficial gas velocity, $U_g$, is less than about 35 $cm.s^{-1}$.

3. A process according to claim 1, in which $Pe_l$ is in the range about 0.005 to about 8.

4. A process according to claim 1, in which the catalyst comprises a group VIII metal.

5. A process according to claim 4, in which the group VIII metal is cobalt.

6. A process according to claim 4, in which the metal is dispersed on a support.

7. A process according to claim 6, in which the support comprises at least one oxide selected from the group consisting of: aluminas, silica, titanium oxide, zirconia and rare earths.

8. A process according to claim 1, in which the temperature is in the range 160° C. to 350° C., the pressure is in the range 0.1 to 10 MPa and the $H_2$/CO mole ratio is in the range 0.5 to 3.

9. A process according to claim 1, in which the three-phase reactor is a slurry bubble column.

10. A process according to claim 9, in which the three-phase reactor has a diameter of more than 2 meters.

11. A process according to claim 2, in which $Pe_l$ is in the range about 0.005 to about 8.

12. A process according to claim 11, in which the catalyst comprises a group VIII metal.

13. A process according to claim 12, in which the temperature is in the range 160° C. to 350° C., the pressure is in the range 0.1 to 10 MPa and the $H_2$/CO mole ratio is in the range 0.5 to 3.

14. A process according to claim 13, in which the three-phase reactor is a slurry bubble column.

15. A process according to claim 14, in which the three-phase reactor has a diameter of more than 2 meters.

16. A process according to claim 1, in which $Pe_l$ is in the range of 0.01 to 5.

17. A process according to claim 1, in which $Pe_l$ is in the range of 0.02 to 3.

18. A process according to claim 1, in which $Pe_l$ is in the range of 0.03 to 1.

19. A process according to claim 1, in which the superficial gas velocity, $U_g$, is less than about 30 $cm.s^{-1}$.

20. A process according to claim 1, in which the temperature is in th range of 200° C. to 300° C., the pressure is in the range 0.5 to 6 MPa and the $H_2$/CO mole ratio is in the range 1.0 to 2.5.

* * * * *